US010518943B2

(12) United States Patent
Gelov et al.

(10) Patent No.: US 10,518,943 B2
(45) Date of Patent: Dec. 31, 2019

(54) CONTAINER WITH VALVE

(71) Applicant: TC HEARTLAND LLC, Carmel, IN (US)

(72) Inventors: Teodor Gelov, Carmel, IN (US); Karen Nichols, Carmel, IN (US); Douglas Norton, Carmel, IN (US)

(73) Assignee: TC Heartland LLC, Carmel, IN (US)

( * ) Notice: Subject to any disclaimer, the term of this patent is extended or adjusted under 35 U.S.C. 154(b) by 0 days.

(21) Appl. No.: 14/775,385

(22) PCT Filed: Mar. 14, 2014

(86) PCT No.: PCT/US2014/029242

§ 371 (c)(1),
(2) Date: Sep. 11, 2015

(87) PCT Pub. No.: WO2014/144714

PCT Pub. Date: Sep. 18, 2014

(65) Prior Publication Data

US 2016/0023818 A1 Jan. 28, 2016

Related U.S. Application Data

(63) Continuation-in-part of application No. 13/844,492, filed on Mar. 15, 2013.

(51) Int. Cl.
*B65D 47/08* (2006.01)
*B65D 35/46* (2006.01)
(Continued)

(52) U.S. Cl.
CPC ..... *B65D 47/0838* (2013.01); *B65D 35/04* (2013.01); *B65D 35/08* (2013.01);
(Continued)

(58) Field of Classification Search
CPC ..... B65D 35/02; B65D 35/04; B65D 35/08; B65D 35/12; B65D 35/40; B65D 35/44;
(Continued)

(56) References Cited

U.S. PATENT DOCUMENTS 1,607,993 A 11/1926 Loewy
1,647,215 A 11/1927 Elsas
(Continued)

FOREIGN PATENT DOCUMENTS

DE 20 2011 106496 U1 11/2011
EP 0 684 188 A1 11/1995
(Continued)

OTHER PUBLICATIONS

Brochure, Design-A-Seal, A Decade of Success, Norden Pac Machinery AB, 2 pages, before Jan. 9, 2013.
(Continued)

*Primary Examiner* — Patrick M. Buechner
(74) *Attorney, Agent, or Firm* — Leydig, Voit & Mayer; John Augustyn

(57) ABSTRACT

The container (100) includes a body portion (102), an upper end portion (104), and a cap portion (106). The body portion, the end portion and the cap portion may be molded as one piece. The cap portion (106) may be attached to the body portion with a hinge (108). The body portion may have a side wall which allows the user to squeeze the side wall and dispense the product which is stored within the container (100). The container may include a valve. The valve may include an opening which allows the contents to be dispensed. The valve may be attached using a retention feature, a retaining ring, an adhesive and/or fusion. The retaining ring may engage the retention feature. After the valve is
(Continued)

assembled to the container (100), the container is filled with a product and the lower end portion may be closed by using a heat seal.

20 Claims, 24 Drawing Sheets

(51) Int. Cl.
*B65D 35/04* (2006.01)
*B65D 35/08* (2006.01)
*B65D 41/62* (2006.01)
*B65D 47/20* (2006.01)

(52) U.S. Cl.
CPC ..... *B65D 35/46* (2013.01); *B65D 41/62* (2013.01); *B65D 47/2031* (2013.01)

(58) Field of Classification Search
CPC .... B65D 35/46; B65D 47/08; B65D 47/0804; B65D 47/2018; B65D 47/0838; B65D 47/2031; B65D 41/62
See application file for complete search history.

(56) References Cited

U.S. PATENT DOCUMENTS 1,696,506 A 12/1928 Smith
1,989,714 A 2/1935 Statham
2,098,799 A 11/1937 Wilson
2,122,299 A 6/1938 Sloan
2,125,250 A 7/1938 Temple
2,128,752 A 8/1938 Lentine
2,147,164 A 2/1939 Kent
2,173,627 A 9/1939 Jecusco
2,473,707 A 6/1949 Hammerstein
2,552,715 A 5/1951 Gray et al.
2,585,527 A 2/1952 Adams
2,679,954 A 6/1954 Barnes
2,758,755 A 8/1956 Schafler
2,904,225 A 9/1959 Earles, Jr.
3,047,910 A 8/1962 Downs
3,063,601 A * 11/1962 Hertz ..... B65D 35/08 222/213
3,081,006 A 3/1963 Land
3,099,372 A 7/1963 Taylor
3,241,726 A 3/1966 Chester
3,349,972 A 10/1967 Whiteford
3,456,650 A 7/1969 Schwartzman
3,481,513 A 12/1969 Ram
4,133,457 A 1/1979 Klassen
4,446,991 A 5/1984 Thompson
4,655,363 A 4/1987 Neat et al.
4,754,896 A 7/1988 Roltgen et al.
4,991,745 A 2/1991 Brown
5,069,856 A 12/1991 Holoubek et al.
5,115,950 A 5/1992 Rohr
5,133,470 A 7/1992 Abrams et al.
5,213,236 A 5/1993 Brown et al.
5,270,011 A 12/1993 Altherr
5,295,599 A 3/1994 Smith
5,339,995 A 8/1994 Brown et al.
5,346,107 A 9/1994 Bouix et al.
5,377,877 A 1/1995 Brown et al.
5,409,144 A 4/1995 Brown
5,439,143 A 8/1995 Brown et al.
5,513,768 A 5/1996 Smith
5,531,353 A 7/1996 Ward et al.
5,531,363 A 7/1996 Gross et al.
5,632,420 A 5/1997 Lohrman et al.
5,667,094 A 9/1997 Rapchak et al.
5,769,253 A 6/1998 Gross
5,839,614 A 11/1998 Brown
5,918,783 A 7/1999 Kieras et al.
5,934,514 A 8/1999 Lampe et al.
5,938,086 A 8/1999 Gross
5,944,234 A * 8/1999 Lampe ..... B65D 47/0804 222/490
5,954,237 A 9/1999 Lampe et al.
6,006,960 A 12/1999 Gross
6,045,004 A * 4/2000 Elliott ..... B65D 47/0804 222/494
6,062,436 A 5/2000 Fuchs
6,089,411 A * 7/2000 Baudin ..... B29C 45/1676 222/212
6,089,419 A 7/2000 Gross
6,095,381 A * 8/2000 Schwanenberg ... B65D 47/2031 222/212
6,145,688 A 11/2000 Smith
6,186,374 B1 2/2001 Gross
6,230,940 B1 5/2001 Manning et al.
6,273,296 B1 8/2001 Brown
6,273,305 B1 8/2001 Fioravanti et al.
6,279,783 B1 8/2001 Brown et al.
6,290,108 B1 9/2001 Gross
6,371,340 B1 4/2002 Pateman et al.
6,375,028 B1 4/2002 Smith
6,398,067 B1 6/2002 Belfance et al.
6,405,901 B1 6/2002 Schantz et al.
6,409,403 B1 6/2002 Woos
6,427,874 B2 8/2002 Brown et al.
6,530,504 B2 3/2003 Socier
6,550,646 B1 4/2003 Takahara et al.
6,622,882 B2 9/2003 Smith
6,672,487 B1 1/2004 Lohrman
6,705,463 B1 3/2004 Bucholtz et al.
6,769,558 B1 8/2004 Bucholtz
6,769,577 B1 8/2004 Feierabend
6,786,363 B1 9/2004 Lohrman
6,874,656 B2 4/2005 Rohr et al.
6,910,607 B2 6/2005 Gaiser et al.
6,951,295 B1 10/2005 Gaus et al.
6,971,558 B2 12/2005 Ramsey et al.
7,077,296 B2 7/2006 Brown et al.
7,117,654 B2 10/2006 Danks
7,152,763 B2 12/2006 Stull et al.
7,195,138 B2 * 3/2007 Foster ..... B65D 47/2068 222/494
7,198,161 B2 4/2007 Bucholtz
7,255,250 B2 8/2007 Pugne
7,299,952 B2 11/2007 Stull et al.
7,387,216 B1 6/2008 Smith
7,398,900 B2 7/2008 Friedman
7,413,083 B2 8/2008 Belfance et al.
7,503,469 B2 3/2009 Bloom et al.
7,472,797 B2 6/2009 Ostrowski
7,699,193 B2 4/2010 Feierabend
7,731,066 B2 6/2010 Norris et al.
7,749,452 B2 7/2010 Brem et al.
7,784,652 B2 8/2010 Gaus et al.
7,854,895 B2 12/2010 Gallagher et al.
7,861,393 B2 1/2011 Pugne
7,886,779 B2 2/2011 Smith
7,915,032 B2 3/2011 Ostrowski et al.
7,980,430 B2 7/2011 Hickok et al.
8,083,094 B2 12/2011 Caulfield et al.
8,167,156 B2 5/2012 Milante
8,322,565 B2 12/2012 Caulfield et al.
8,397,956 B2 3/2013 Olechowski
8,397,957 B2 3/2013 Bloom et al.
8,397,958 B2 3/2013 Smith et al.
8,763,859 B2 7/2014 Cain
8,794,489 B2 8/2014 Bloom
8,820,591 B2 9/2014 Smith
D728,378 S 5/2015 Gelov
2002/0014501 A1 2/2002 Nyman et al.
2002/0088814 A1 7/2002 Belfance et al.
2002/0125272 A1 9/2002 Sekendur
2003/0047572 A1 3/2003 Masuda
2003/0106910 A1 * 6/2003 Hicks ..... B65D 47/0847 222/494
2003/0173379 A1 * 9/2003 Gaiser ..... B65D 47/2031 222/494
2004/0251278 A1 12/2004 Arai

(56) References Cited

U.S. PATENT DOCUMENTS

2004/0262338 A1* 12/2004 Lee ..... B65D 47/0809 222/494
2005/0242132 A1 11/2005 Morini
2006/0006203 A1* 1/2006 Stull ..... B29C 45/0081 222/494
2006/0043100 A1 3/2006 Johnson et al.
2006/0138163 A1* 6/2006 Danks ..... B65D 51/1611 222/1
2006/0169723 A1* 8/2006 Friedman ..... B65D 47/0814 222/213
2006/0201976 A1 9/2006 Bloom et al.
2006/0249545 A1* 11/2006 Ramsey ..... B65D 47/2031 222/494
2007/0023462 A1* 2/2007 Pugne ..... B65D 47/0804 222/556
2007/0029352 A1* 2/2007 Norris ..... B65D 47/2031 222/494
2007/0145073 A1 6/2007 Morini
2007/0267451 A1* 11/2007 Robinson ..... B65D 35/38 222/546
2007/0284397 A1 12/2007 Hickok et al.
2008/0135429 A1 6/2008 Wright
2008/0173677 A1* 7/2008 Hickok ..... B65D 47/2031 222/494
2008/0237271 A1* 10/2008 Olechowski ..... B65D 47/2031 222/494
2009/0050648 A1* 2/2009 Wisniewski ..... B65D 47/2031 222/83
2009/0065528 A1 3/2009 Bray
2010/0065561 A1 3/2010 Valley, III et al.
2010/0224646 A1 9/2010 Incorvia et al.
2011/0089187 A1 4/2011 Streiger et al.
2012/0055946 A1 3/2012 Caulfield et al.
2012/0055947 A1 3/2012 Caulfield et al.
2012/0080450 A1 4/2012 Dziersk et al.
2012/0114800 A1* 5/2012 McKay ..... A23L 2/52 426/72
2013/0026168 A1* 1/2013 Mazurkiewicz ... B65D 47/0814 220/254.1
2013/0161344 A1 6/2013 Park et al.
2014/0138408 A1 5/2014 Loya
2014/0144870 A1 5/2014 Brosius
2014/0151397 A1 6/2014 Murphy et al.
2014/0151406 A1 6/2014 Murphy et al.
2016/0236827 A1 8/2016 Adams et al.

FOREIGN PATENT DOCUMENTS

EP 0 887 278 B1 12/1998
WO 2004/005149 A1 1/2004
WO 2004/099024 A1 11/2004

OTHER PUBLICATIONS

PCT Notification of Transmittal of the International Search Report and Written Opinion dated Aug. 7, 2014.

* cited by examiner

CONTAINER WITH VALVE

BACKGROUND

A container may be used to dispense a material. For example, a tooth paste tube container may be used to dispense toothpaste. Some tooth paste containers are made using three separate components. For example, the tooth paste container includes a tube portion, an upper portion and a cap. In addition, these parts are separately made and then assembled together. For example, the tube portion is made, then the upper portion is made, such as by molding, and then the upper portion is attached to the tube portion, such as by sonic welding. Finally, a cap is molded and then attached to the upper portion, such as by threads. This process involves several separate parts which are separately formed and then assembled in several steps. There is a need for a container which has less parts and which is less expensive to manufacture.

BRIEF SUMMARY

The invention provides a container which includes a body portion, an upper end portion, and a cap portion. In one embodiment, the body portion may be a tube portion. The body portion, the end portion and the cap portion may be molded as one piece. The cap portion may be attached to the body portion with a hinge. The hinge may be a living hinge.

The body portion may have a side wall. The side wall may have a thickness which allows the user to squeeze the side wall and dispense the product which is stored within the container.

The upper end portion may be used to dispense the contents of the container. The end portion may include an opening. The container may include a valve. The valve will seal the opening. The valve may include an opening which allows the product to be dispensed. The valve may be attached to the container. In one embodiment, the valve may be attached to the end portion.

The valve may be attached using a retention feature. In other embodiments, the valve may be attached using an adhesive or fusion such as sonic welding.

The container may include a valve retaining ring. The retaining ring may engage the retention feature. The valve may be located between the retaining ring and the end portion. In one embodiment, the retaining ring is a part which is separate from the valve. In another embodiment, the valve may be molded onto the retaining ring.

After the valve is assembled to the upper end portion, the container is filled with a product, such as, a liquid beverage enhancer. The lower end portion is then closed. In one embodiment, the lower end portion may be closed by using a heat seal. The heat seal may seal one portion of the side wall against another portion of the side wall. The heat seal may be sealed and trimmed to have various shapes.

DETAILED DESCRIPTION

Figure 1:
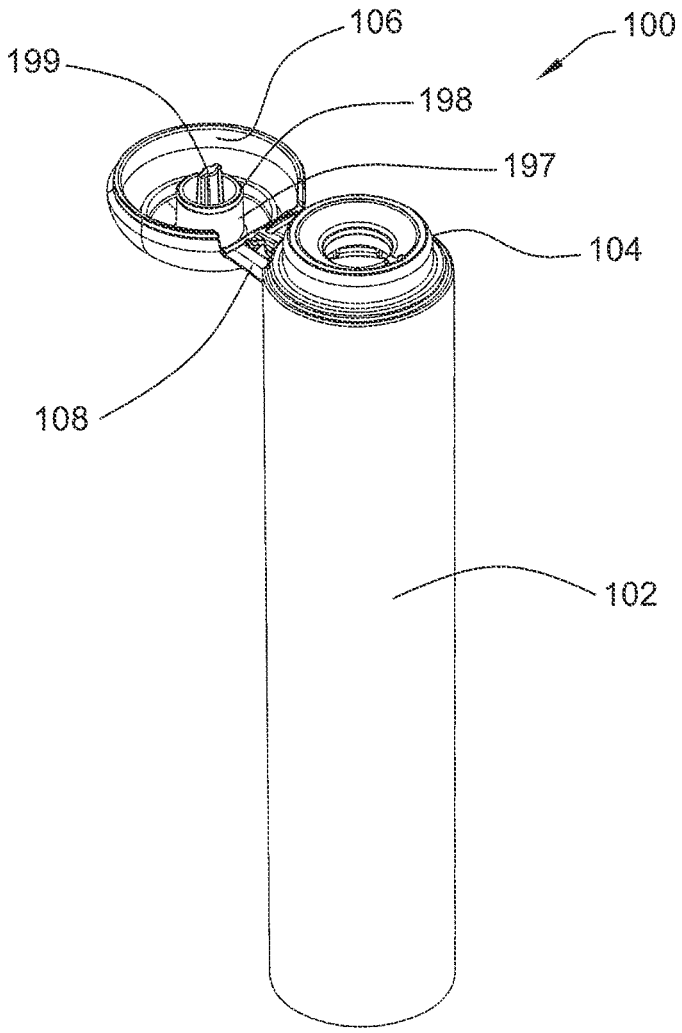
FIG. 1 is a perspective view of a container.
Figure 2:
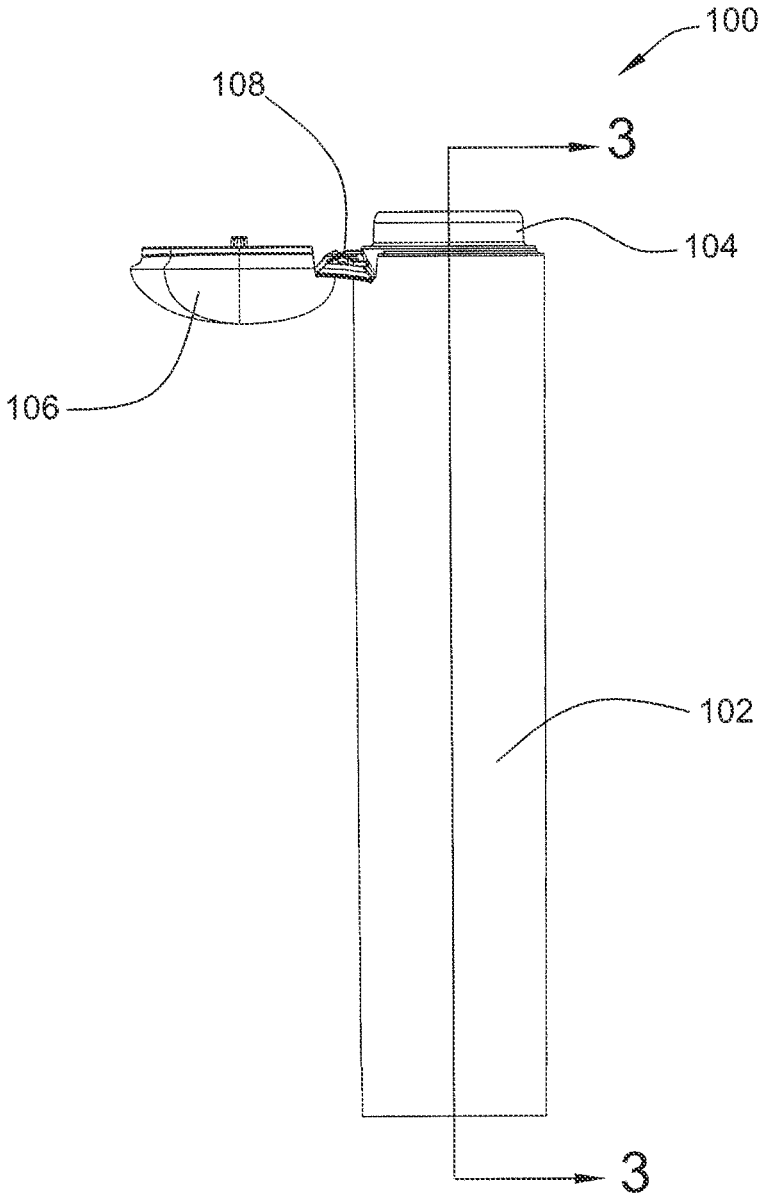
FIG. 2 is a side view of the container in FIG. 1.

Referring to FIGS. 1 and 2, the container 100 includes a body portion 102, an upper end portion 104, and a cap portion 106. The body portion 102, the end portion 104 and the cap portion 106 may be molded as one piece. For example, the body portion 102, the end portion 104 and the cap portion 106 may be molded on an injection molding machine. In one embodiment, the body portion, the upper end portion and the cap portion may be made of polypropylene. In other embodiments, the body portion, the upper end portion and the cap portion may be made of low density polyethylene, medium density polyethylene, or high density polyethylene. In one embodiment, the body portion may be a tube portion.

Figure 16:
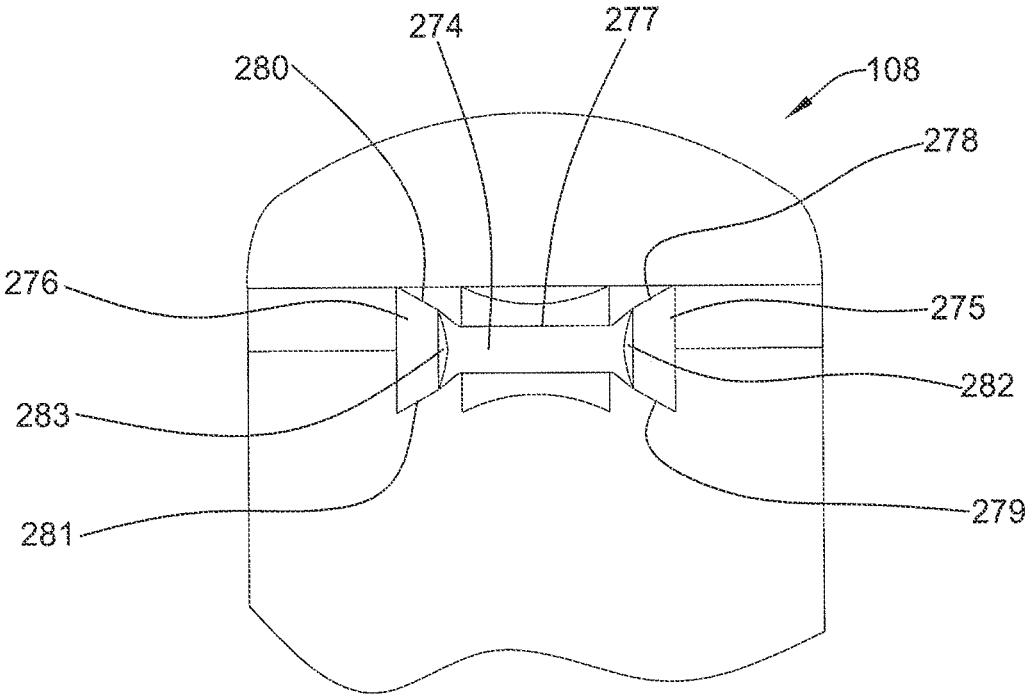
FIG. 16 is a rear view of the container showing a first embodiment of a hinge.
Figure 17:
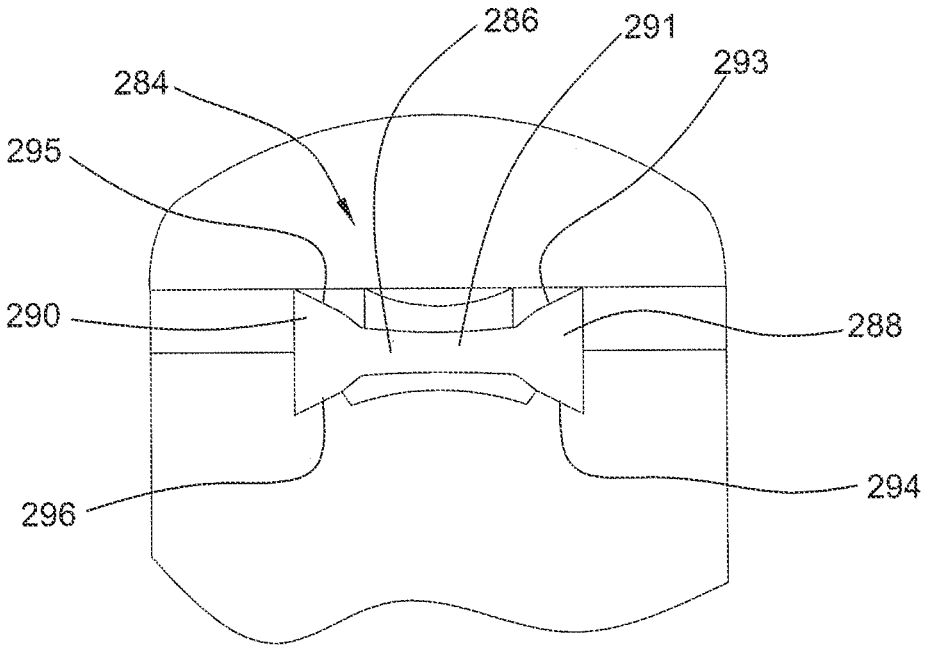
FIG. 17 is a rear view of the container showing a second embodiment of a hinge.

The cap portion 106 is attached to the body portion 102 with a hinge 108. The hinge 108 may be a living hinge. In one embodiment, the hinge may be a three part hinge as shown in FIG. 16. In another embodiment, the hinge may be a butterfly hinge as shown in FIG. 17.

Figure 3:
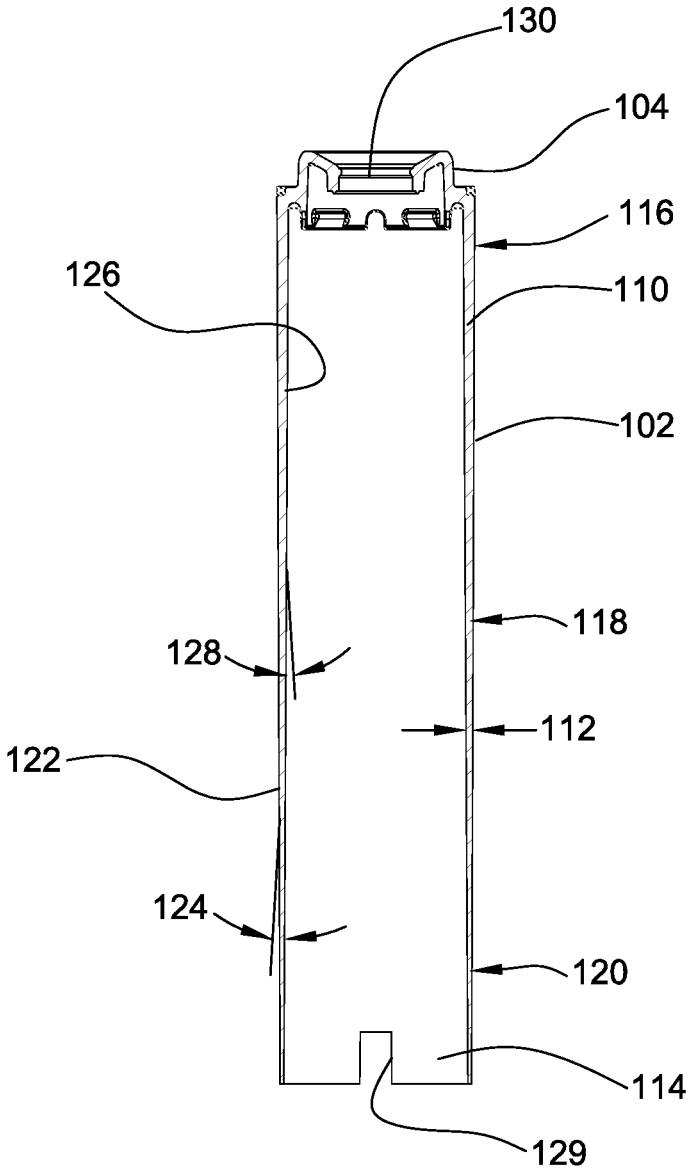
FIG. 3 is a cross-sectional view taken along line 3-3 of FIG. 2.

Referring to FIG. 3, the body portion 102 may have a side wall. In one embodiment, the side wall 110 may have a thickness 112 which allows the user to squeeze the side wall and dispense the product which is stored within the container. In one embodiment, the side wall 110 may be deflected with the application of a force in the range of about 3 to about 15 pounds to cause the valve to actuate and to dispense a stream of liquid.

In one embodiment, the side wall 110 is thicker near the upper end portion 104 and thinner near the lower end portion 114. In one embodiment, the thickness at location 116 may be 0.03 inches (0.076 cm), the thickness at location 118 may be 0.025 inches (0.064 cm), and the thickness at location 120 may be 0.014 inches (0.036 cm).

In one embodiment, the thickness of the side wall may taper from the upper end portion 104 to the lower end portion 114. In one embodiment, the outside surface 122 of the body portion may have an angle 124 with respect to the vertical axis in the range from about 1/32 (0.031) of a degree to about 1/4 (0.25) of a degree. In one example, the angle 124 may be 0.195 of a degree. In one embodiment, the inside surface 126 of the body portion may have an angle 128 with respect to the vertical axis in the range from about 1/32 (0.031) of a degree to about 1/4 (0.25) of a degree. In one example, the angle 128 may be 1/16 (0.0625) of a degree. The taper may facilitate the removal of the body container from the mold.

The body portion may include a location feature. In one embodiment, the location feature may be a notch 129 as shown in FIG. 3. The notch may be used to position the container in the proper position to receive a label. The assembly equipment may include a portion which would engage the notch to locate the container in a specific position. A label may be placed onto the container while the container is held in position. By holding the container in a specific position, the label may be placed in the proper orientation relative to the container. The proper orientation may be beneficial when the container has a specific orientation, such as, when the container is not symmetrical or when the hinge or other feature is in a specific location. For example, in one embodiment, the container is not symmetrical and the hinge is in a specific location as in FIGS. 14 and 15.

In other embodiments, other location features may be used. For example, the body portion may include an upwardly extending portion, such as a tab. The tab may engage a portion of the assembly equipment.

In another embodiment, the assembly equipment may use a sensor, such as an optical sensor or a displacement sensor, which can sense the location of a feature on the container, such as the hinge or the lift tab.

Figure 5:
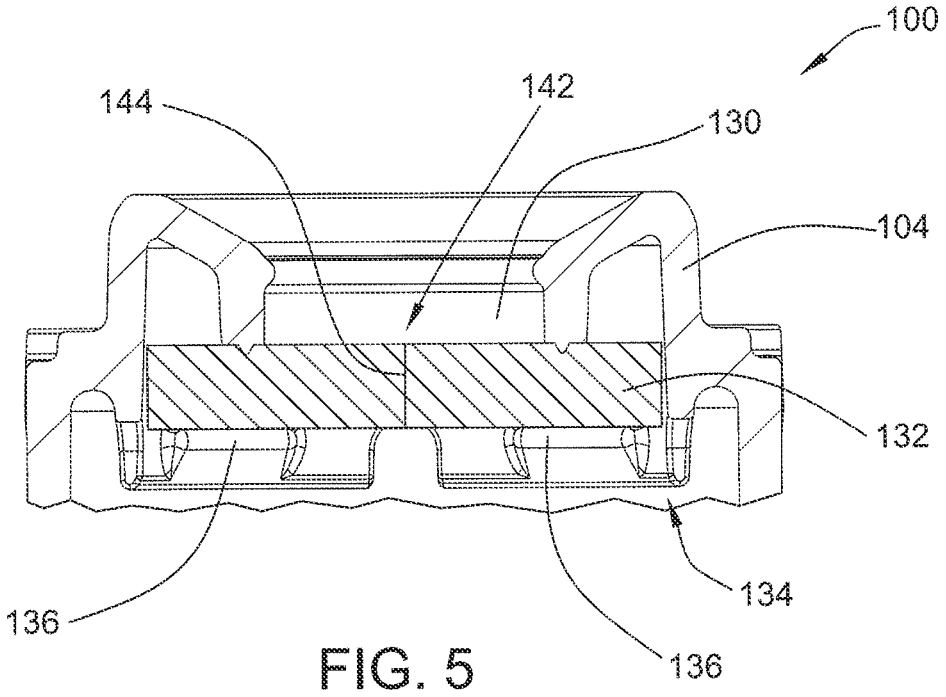
FIG. 5 is a cross-sectional view similar to FIG. 4 with a first embodiment of a valve.

The upper end portion 104 may be used to dispense the contents of the container. The end portion 104 may include an opening 130. Referring to FIG. 5, the container 100 may include a valve 132. The valve 132 will seal the opening 130 and allow the contents to be dispensed from the container.

Figure 4:
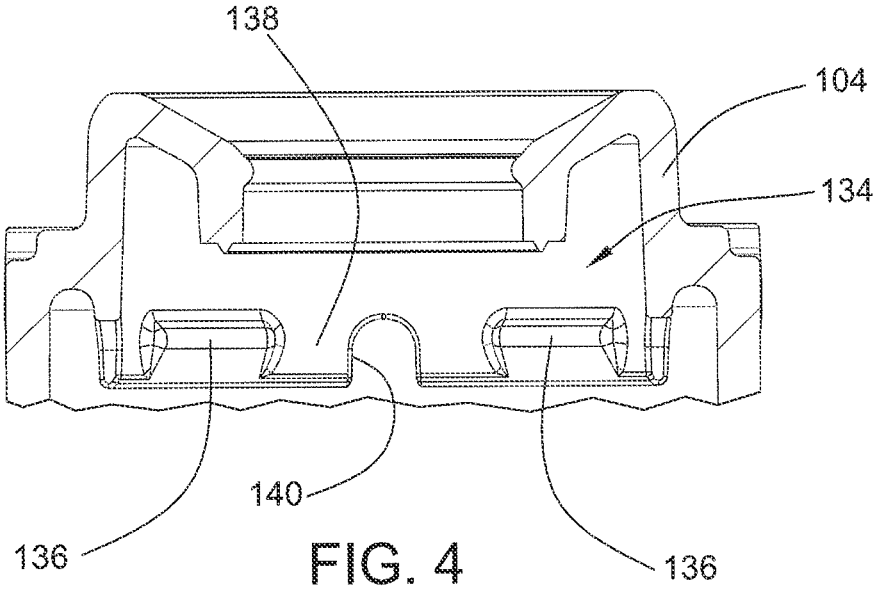
FIG. 4 is an enlarged view of the end in FIG. 3.

Referring to FIGS. 4 and 5, the end portion 104 may include a retention feature. The retention feature 134 may be used to hold the valve 132 onto the end portion 104. In one embodiment, the retention feature 134 may be a protrusion 136. In one embodiment, the protrusion 136 may extend inwardly toward the center of the body portion. The end portion may include one, two, three, four or more protrusions. In one embodiment, the end portion may include four protrusions 136. The retention feature 134 will engage the valve 132 in order to hold the valve 132 onto the container.

In one embodiment, the retention feature 134 may be located on an inner surface of the end portion. For example, referring to FIG. 4, the retention feature may be located on a wall 138. The wall 138 may extend downwardly.

Referring to FIG. 4, the wall 138 may include a notch 140. In one embodiment, the notch is U-shaped. In other embodiments, the notch may be other shapes, such as, V-shaped, square, or rectangular. The wall 138 may have one, two, three, four or more notches. In one embodiment, the wall 138 has four notches 140. In one embodiment, the notch 140 may be located between a first protrusion 136 and a second protrusion 136. In an embodiment which includes more than two protrusions 136, a notch 140 may be located between each adjacent pair of protrusions. For example, in an embodiment which includes four protrusions 136, a first notch 140 may be located between the first protrusion and the second protrusion, a second notch may be located between the second protrusion and the third protrusion, a third notch may be located between the third protrusion and the fourth protrusion, and a fourth notch may be located between the fourth protrusion and the first protrusion.

The notch 140 may facilitate the insertion of the valve. The notch 140 may allow the retention feature 134 to deflect so that the valve may be inserted. In addition, the notch may facilitate the removal of the container from a molding machine.

Referring to FIG. 5, the valve 132 may be made of a flexible material. In one embodiment, the valve may be made of silicone. In other embodiments, the valve may be made of a thermoplastic elastomer. The valve 132 may include an opening 142 which allows the contents to be dispensed. In one embodiment, the opening 142 may be a slit 144. In a second embodiment, the opening may be two slits. The first slit may cross the second slit at an angle. In one embodiment, the angle may be 90 degrees. In other embodiments, the angle may be between 1 degree and 89 degrees.

The valve 132 may be attached to the container. Referring to FIG. 5, in one embodiment, the valve 132 may be attached to the end portion 104. The valve 132 may be attached using the retention feature 134. In other embodiments, the valve may be attached using an adhesive, fusion (such as sonic welding) or deformation of the container (such as, by crimping with or without heating). In another embodiment, the valve 132 may be used with a retaining ring as discussed below.

Figure 6:
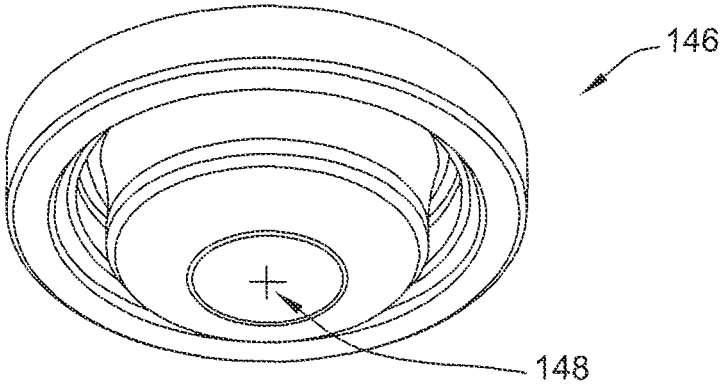
FIG. 6 is a perspective view of a second embodiment of a valve.
Figure 7:
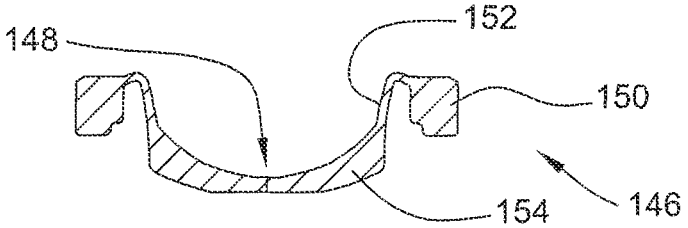
FIG. 7 is a cross-sectional view of FIG. 6.
Figure 9:
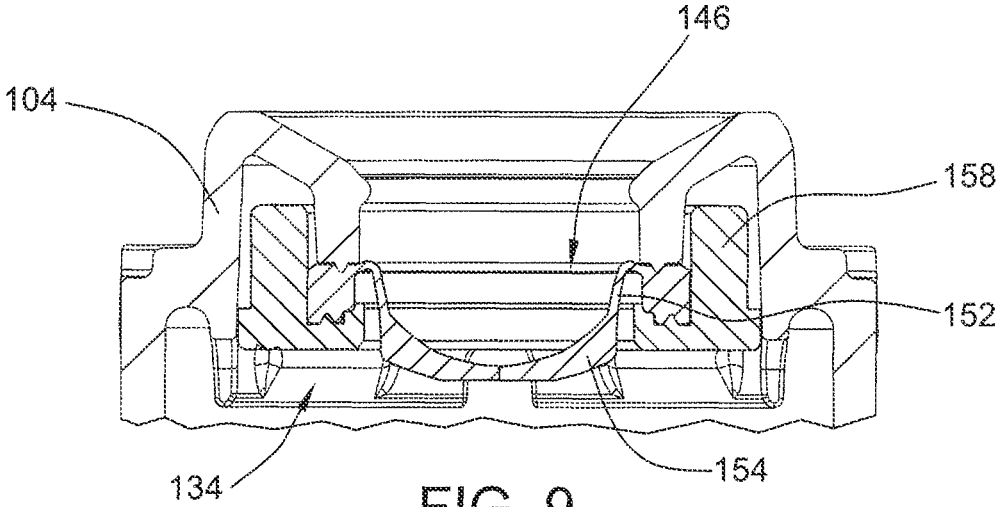
FIG. 9 is a cross-sectional view of the valve and retaining ring assembled onto the container.
Figure 10:
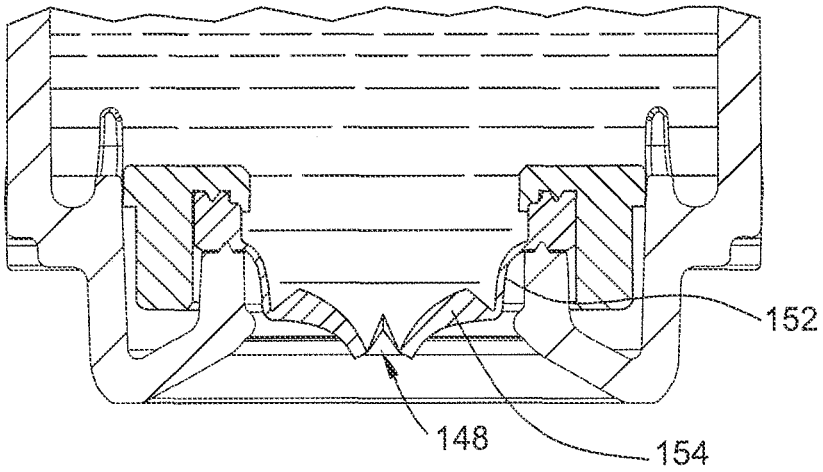
FIG. 10 is a cross-sectional view of the valve in FIG. 9 in the open position.

Referring to FIGS. 6 and 7, a second embodiment of a valve is shown. The valve 146 may include an opening 148. The opening 148 may be any one of the openings discussed above for valve 132. Referring to FIG. 7, the valve 146 may include an outer portion 150, an intermediate portion 152, and an inner portion 154. When pressure is applied to the exterior of the container, the interior pressure of the container will cause the intermediate portion 152 and the inner portion 154 to deflect outwards as shown in FIG. 10 and allow the contents to exit the opening 148. When the pressure is removed, the intermediate portion 152 and the inner portion 154 return to the positions shown in FIG. 9. The valve 146 may be attached using the retention feature 134. In other embodiments, the valve may be attached using an adhesive, fusion (such as sonic welding) or deformation of the container (such as, by crimping with or without heating). In another embodiment, the valve 146 may be used with a retaining ring 158 as discussed below.

Figure 8:
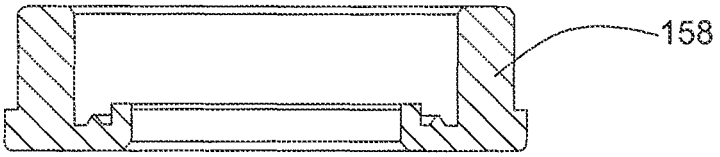
FIG. 8 is a cross-sectional view of a valve retaining ring.

The container 100 may include a valve retaining ring. Referring to FIGS. 8 and 9, the retaining ring 158 may engage the retention feature 134. The valve 146 may be located between the retaining ring 158 and the end portion 104. In one embodiment, the retaining ring 158 is a part which is separate from the valve 146. The retaining ring 158 may be made of a material which is harder than the valve 146. For example, the valve may be made of silicone and the retaining ring may be made of polypropylene. In other embodiments, the valve may be made of a thermoplastic elastomer. In other embodiments, the ring may be made of nylon, or polyamide. In one embodiment, the valve 146 may be inserted into the container and then the retaining ring 158 may be inserted into the container. The retaining ring 158 may then engage the retention feature 134. In another embodiment, the valve may be molded onto the retaining ring as shown in FIGS. 11 and 12.

Figure 11:
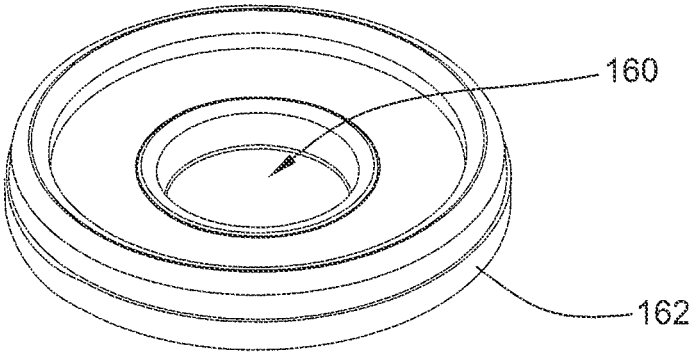
FIG. 11 is a perspective of a third embodiment of a valve.
Figure 12:
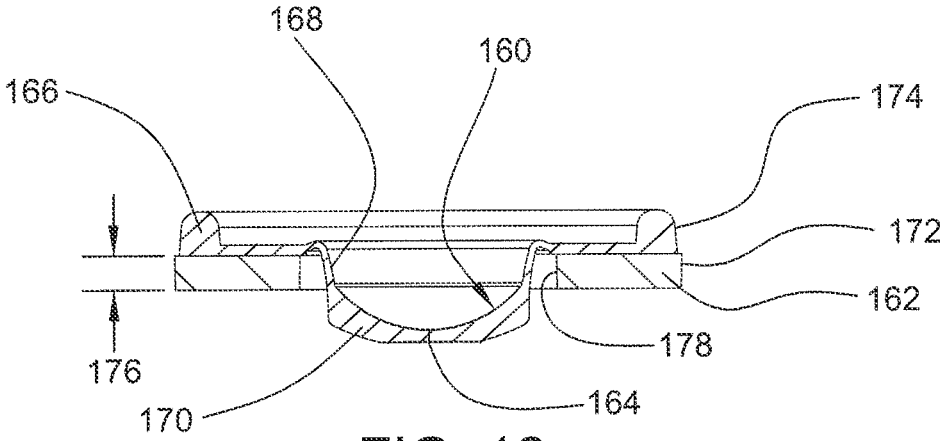
FIG. 12 is a cross-sectional view of FIG. 11.
Figure 13:
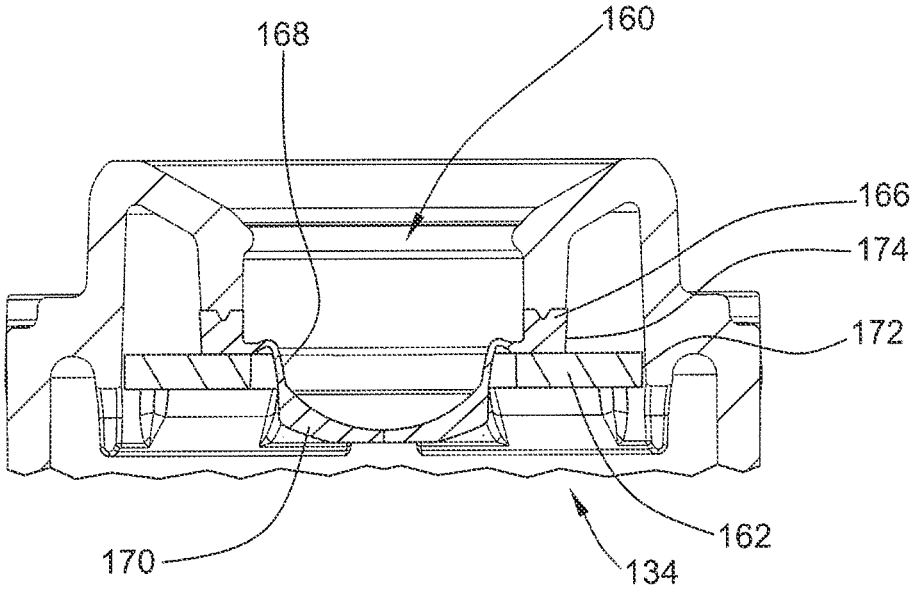
FIG. 13 is a cross-sectional view of a valve and retaining ring assembled onto the container.

Referring to FIGS. 11 and 12, a third embodiment of a valve is shown. The valve 160 may be molded onto a retaining ring 162. The retaining ring 162 may be made of a material which is harder than the valve 160. For example, the valve may be made of silicone and the retaining ring may be made of polypropylene. In other embodiments, the valve may be made of a thermoplastic elastomer. In other embodiments, the ring may be made of nylon, or polyamide. Referring to FIG. 13, the valve 160 may be attached using the retention feature 134. In one embodiment, the valve 160 and retaining ring 162 may be inserted into the container. The retaining ring 162 may then engage the retention feature 134. Referring to FIG. 12, the valve 160 may include an opening 164. The opening 164 may be any one of the openings discussed above for valve 132. The valve 160 may include an outer portion 166, an intermediate portion 168, and an inner portion 170. When pressure is applied to the exterior of the container, the interior pressure of the container will cause the intermediate portion 168 and the inner portion 170 to deflect outwards and allow the product to exit the opening 164. When the pressure is removed, the intermediate portion 168 and the inner portion 170 return to the positions shown in FIG. 12.

Referring to FIG. 12, the retaining ring 162 may be larger than valve 160. For example, the outer perimeter 172 of the retaining ring 162 may be greater than the outer perimeter 174 of the valve 160. Thus, in situations which require a large outer perimeter 172 for the retaining ring 162, the size of the outer perimeter 172 can be increased but the size of the valve 160 can remain the same. Therefore, the manufacturer can increase or decrease the outer perimeter 172 of the retaining ring to fit in several different sizes and types of containers without having to change the size of the valve 160. In addition, the manufacturer could also increase or decrease the thickness 176 of the retaining ring 162 in order to fit in several different sizes and types of containers without having to change the size of the valve 160.

The outer perimeter 172 of the outer portion 166 of the valve may be increased or decreased in order to fit several different sizes and types of containers without having to change the size of the moving portions of the valve 160. In one embodiment, the moving portions of the valve 160 are the intermediate portion 168 and the inner portion 170. For example, referring to FIG. 13, the outer perimeter 174 of the outer portion 166 has been decreased as compared to FIG. 12 without changing the size of the intermediate portion 168 and the inner portion 170.

In another embodiment, the size of the moving parts of the valve can be increased or decreased. For example, the size of the intermediate portion 168 and the inner portion 170 of the valve 160 may need to increase in order to accommodate a more viscous fluid. In addition, the size of the inner opening 178 of the retaining ring 162 can be increased or decreased to accommodate the increase or decrease of the intermediate portion 168 and the inner portion 170 of the valve, but the outer periphery 172 of the retaining ring 162 can remain the same. Therefore, if the manufacturer decides to change the viscosity of the fluid in the container, the manufacturer can increase or decrease the size of intermediate portion 168 and inner portion 170 of the valve, but the manufacturer can use the same container since the outer periphery 172 of the retaining ring 162 remains the same. In some situations the size of the outer portion 166 of the valve may change in size.

After the valve is assembled to the upper end portion 104, the container 100 is filled with a product. The product may be a liquid beverage enhancer. In other embodiments, the product may be sweeteners or nutraceuticals. The product may have a viscosity in the first range of about 1 to about 250 centipoise at room temperature, a second range of about 1 to about 90 centipoise at room temperature, and a third range of about 1 to about 50 centipoise at room temperature.

Figure 14:
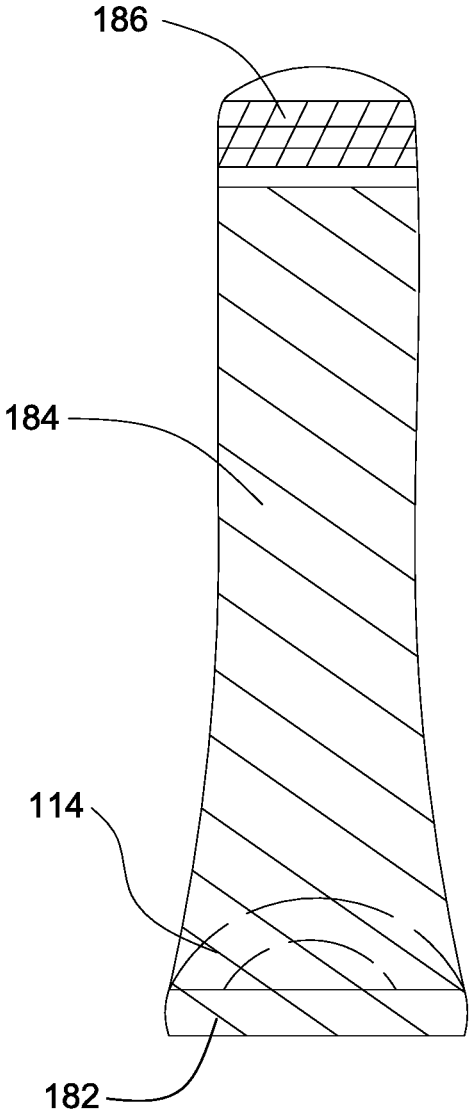
FIG. 14 is a front view of the container with a closed end.
Figure 15:
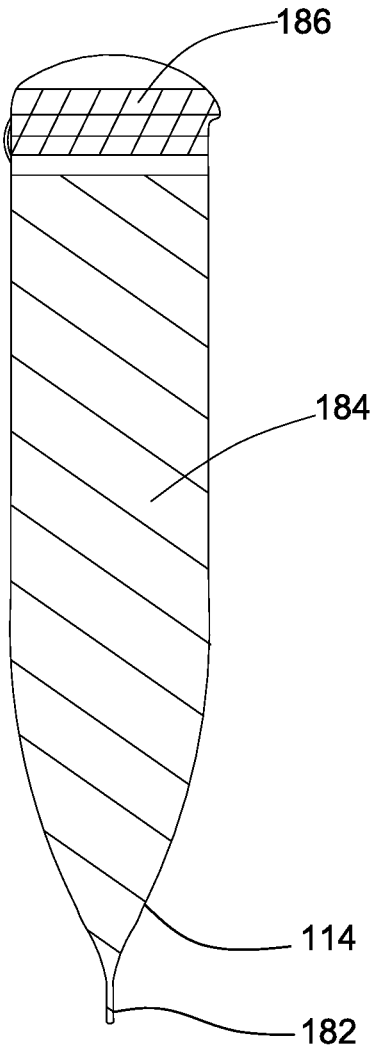
FIG. 15 is a side view of the container with a closed end.

After the container is filled with a product, the lower end portion 114 is then closed. Referring to FIGS. 14 and 15, in one embodiment, the lower end portion 114 may be closed by using a heat seal 182. The heat seal 182 may seal one portion of the side wall 110 against another portion of the side wall 110. The heat seal 182 may be sealed and trimmed to have various shapes. For example, the heat seal may be trimmed to be straight, wavy, with an opening for hanging, a trademarked shape, trademarked opening, a decoration, or an opening for a lanyard. In other embodiments, the lower end portion 114 may be closed with a plug or cap which may be attached to the end portion 114 with an adhesive, fusion (such as sonic welding) or deformation of the container (such as, by crimping with or without heating).

In one embodiment, the container may have product information. Referring to FIGS. 14 and 15, in one embodiment, the product information may be a label 184. The label 184 may be applied with an adhesive. In other embodiments, the label may be applied with shrink wrap.

In other embodiments, the product information may be placed on the container using other techniques. For example, the product information may be printed onto the container. In another example, the product information may be embossed onto the container. In a third example, the product information may be applied by in-mold labeling.

In one embodiment, the container may include a tamper evident feature. In one example, the tamper evident feature may be a band 186. The band 186 may be applied over a portion of the body and a portion of the cap. If a person breaks the band to open the cap, then a subsequent person would know that the container was previously opened. In one embodiment, the band may be applied by heat shrinking In other embodiments, the band may be applied with an adhesive.

In another embodiment, the label may extend over a portion of the cap and the label may provide a tamper evident feature. Thus, the band may not be needed.

FIG. 16 shows a first embodiment of a hinge. The hinge 108 may be a three part hinge. The hinge 108 may include a center portion 274, a first outer portion 275, and a second outer portion 276. The center portion 274 may include a hinge 277. The first outer portion 275 may include an upper hinge 278 and a lower hinge 279. The second outer portion 276 may include an upper hinge 280 and a lower hinge 281. The center portion 274 and the first outer portion 275 may be separated by a first space 282. The center portion 274 and the second outer portion 276 may be separated by a second space 283. When the cap portion is opened, the upper hinges 278, 280, the lower hinges 279, 281 and the hinge 277 may bend. In addition, when the cap is opened, the outer portions 275, 276 may bend.

FIG. 17 shows a second embodiment of a hinge. The hinge 284 may be a butterfly hinge. The hinge 284 may include a center portion 286, a first outer portion 288, and a second outer portion 290. The center portion 286 may include a hinge 291. The first outer portion 288 may include an upper hinge 293 and a lower hinge 294. The second outer portion 290 may include an upper hinge 295 and a lower hinge 296. When the cap portion is opened, the upper hinges 293, 295, the lower hinges 294, 296, and hinge 291 may bend. In addition, when the cap is opened, the outer portions 288, 290 may bend.

In other embodiments, the container may have other hinges, such as, a one part hinge, or a two part hinge.

Figure 18:
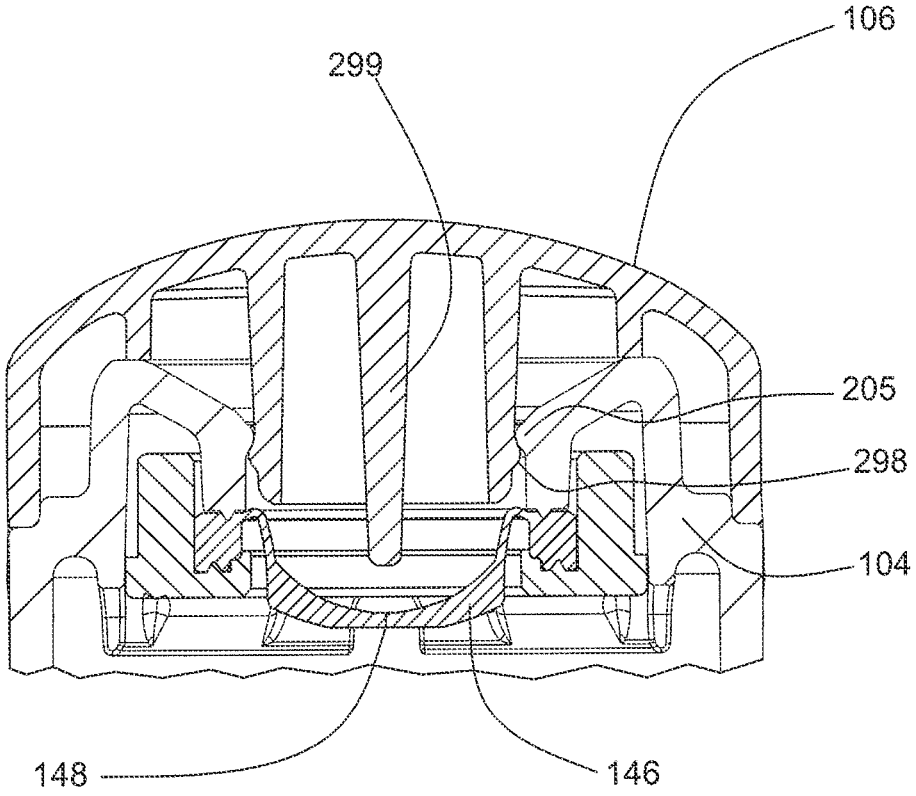
FIG. 18 is s cross-sectional view with the cap portion in a closed position.

Referring to FIG. 1, the cap 106 may include an annular wall 297. The annular wall 297 may include a rib 298. The cap 106 may also include a projection 299. Referring to FIG. 18, when the cap 106 is closed, the cap 106 may engage the end portion 104. The end portion 104 may have a ridge 205. The ridge 205 may engage the rib 298 in order to maintain the cap 106 in a closed position. The engagement may also provide an audible indication that the cap is in the closed position. The projection 299 extends downward toward the valve 146. The projection 299 may limit the outward deflection of the valve 146 and may not allow the opening 148 to open. Thus, the projection 299 may prevent the product from exiting the valve 146 when the cap 106 is in the closed position.

The container may be designed to hold a specific amount of the product. In a first embodiment, the container can hold no less than 2 ml and no more than 100 ml. In a second embodiment, the container can hold no less than 2 ml and no more than 50 ml. In a third embodiment, the container can hold no less than 2 ml and no more than 36 ml. In a fourth embodiment, the container can hold no less than 2 ml and no more than 24 ml. In a fifth embodiment, the container can hold no less than 2 ml and no more than 12 ml. In a sixth embodiment, the container can hold no less than 2 ml and no more than 8 ml. In a seventh embodiment, the container can hold no less than 2 ml and no more than 4 ml.

Figure 19:
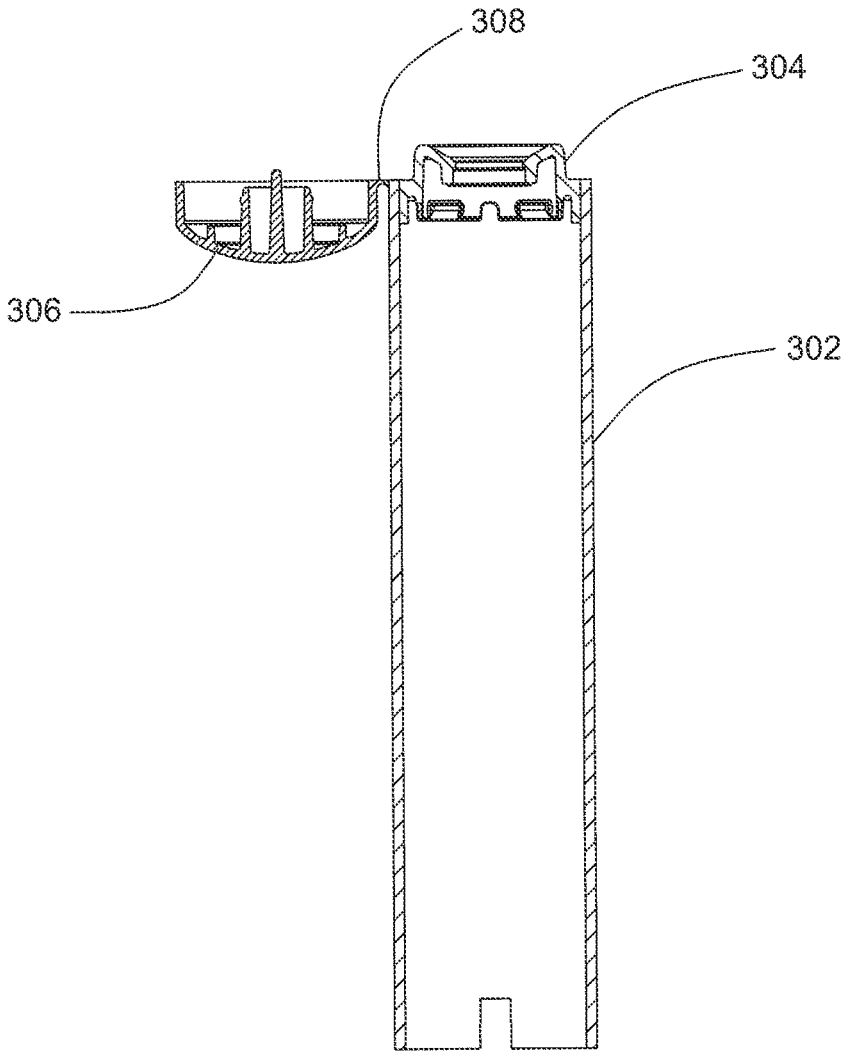
FIG. 19 is a cross-sectional view of another embodiment of a container.

In another embodiment, the body portion may be attached to the upper end portion. In one embodiment, referring to FIG. 19, the body portion 302 may be attached to the upper end portion 304 with fusion, such as, sonic welding. In other embodiments, the body portion may be attached to the upper end portion with an adhesive, or with heat. In one embodiment, the upper end portion 304 may include a cap portion 306. The cap portion 306 may be attached with a hinge 308. The hinge 308 may be one of the hinges noted herein.

Figure 20:
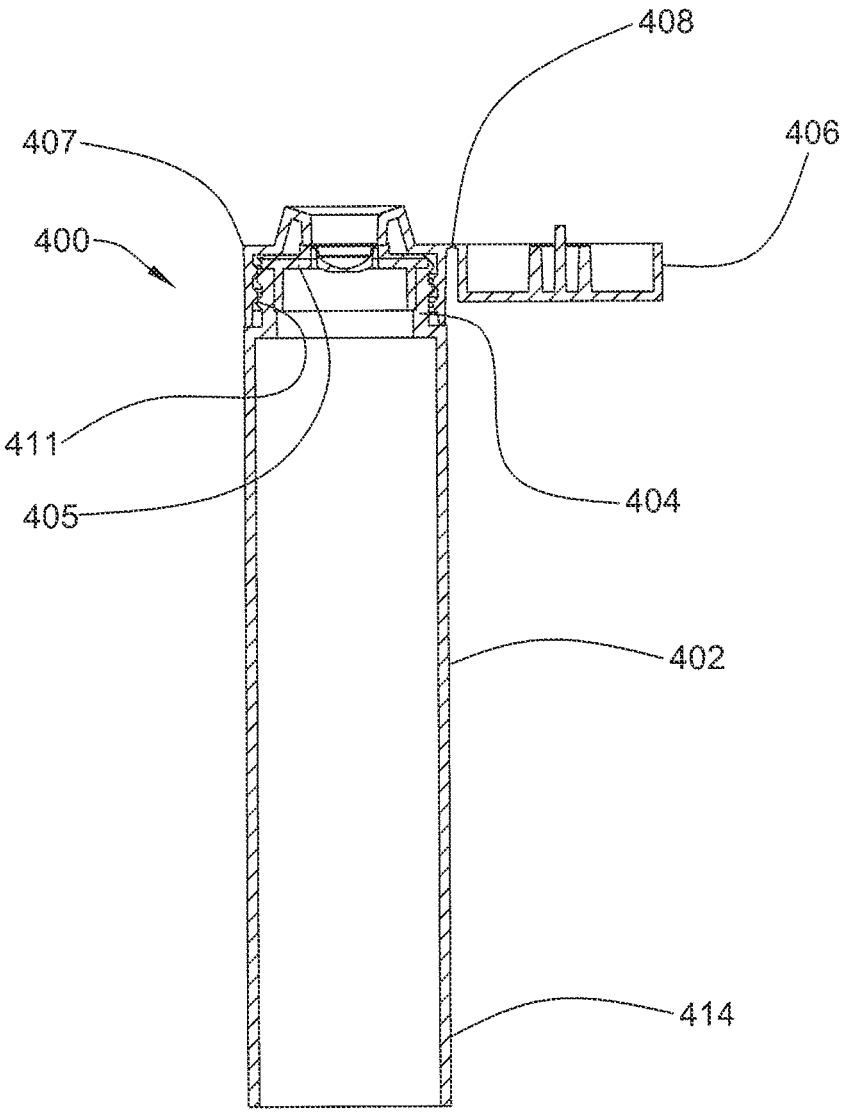
FIG. 20 is a cross-sectional view of another embodiment of a container.

Referring to FIG. 20, another embodiment of a container is shown. The container 400 may include a body portion 402, an upper end portion 404, and a plug seal 405. In one embodiment, the container 400 may include a cap portion 406, a base portion 407, and a hinge portion 408. The hinge portion 408 may be one of the hinges noted herein. In this embodiment, the base portion 407 may be attached to the end portion 404 with threads. In this embodiment, the body portion 402 may be a tube and the lower end portion 414 may be closed as noted herein.

Figure 21:
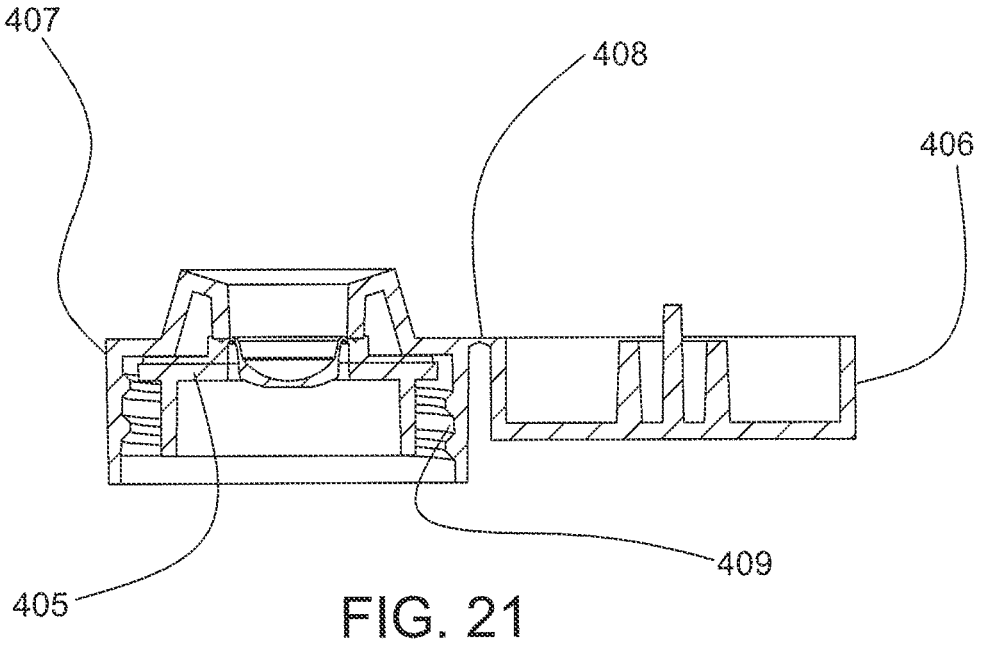
FIG. 21 is a cross-sectional view of a base portion and a cap portion from FIG. 20.

Referring to FIG. 21, the cap portion 406, a base portion 407, and a hinge portion 408 are shown. The base portion 407 includes threads 409. The threads 409 may engage threads 411 on the end portion 404. The plug seal 405 is also shown inserted into the base portion 407.

Figure 22:
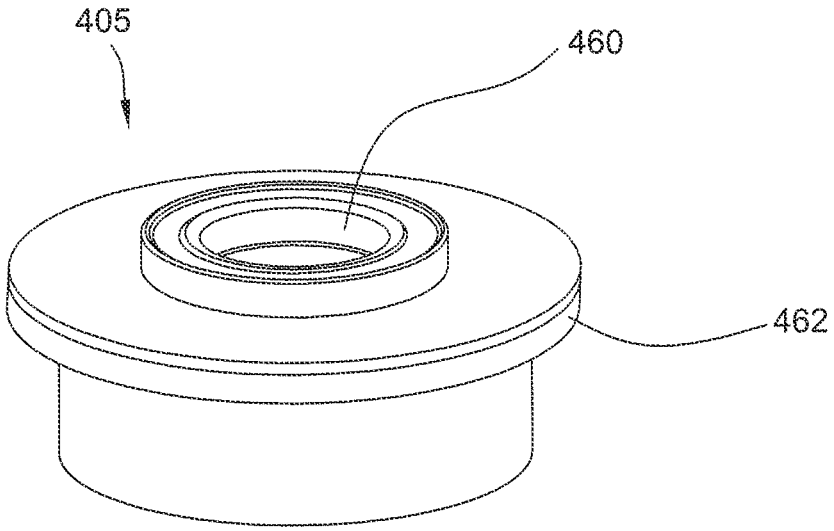
FIG. 22 is a top perspective view of the plug seal.
Figure 23:
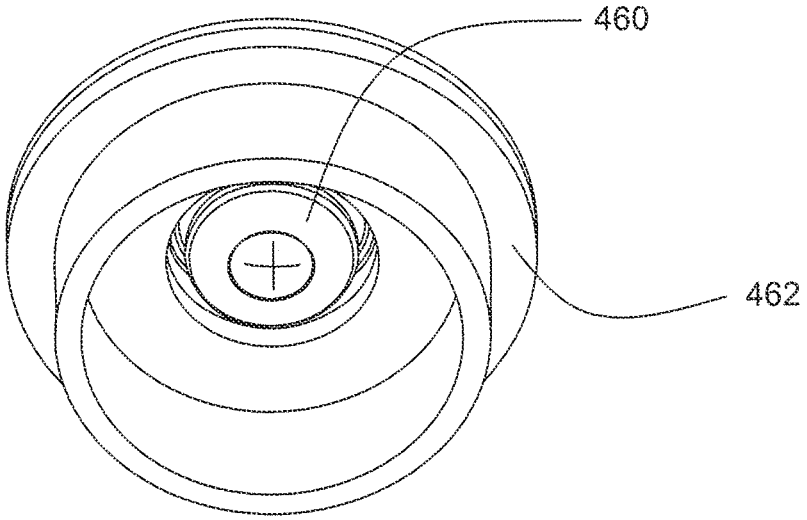
FIG. 23 is a bottom perspective view of the plug seal.
Figure 24:
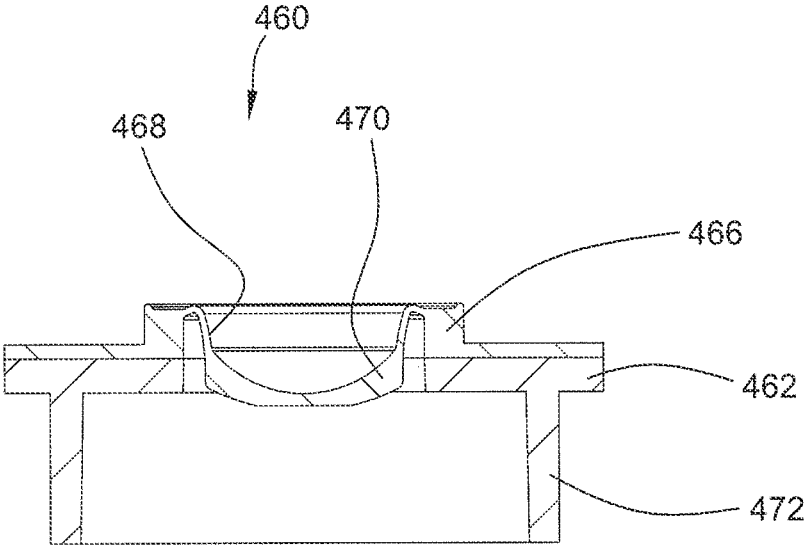
FIG. 24 is a cross-sectional view of the plug seal.

Referring to FIGS. 22-24, the plug seal 405 is shown. The plug seal 405 may include a valve 460 and a retaining ring 462. The valve 460 may be molded onto the retaining ring 462. The valve 460 may be made of materials which are noted above for valve 160. The retaining ring 462 may be made of materials which are noted above for the retaining ring 162.

Referring to FIG. 24, the valve 460 may include an outer portion 466, an intermediate portion 468, and an inner portion 470. The intermediate portion 468 and the inner portion 470 may be the same as the intermediate portion 168 and the inner portion 170. In addition, the intermediate portion 468 and the inner portion 470 may operate in the same manner as the intermediate portion 168 and the inner portion 170. The retaining ring 462 may have an annular wall 472 which extends downwards. The wall 472 engages the interior of the container. In one embodiment, the wall 472 makes a sealing engagement with the container. For example, the wall 472 may make a sealing engagement with the end portion 404.

Figure 25:
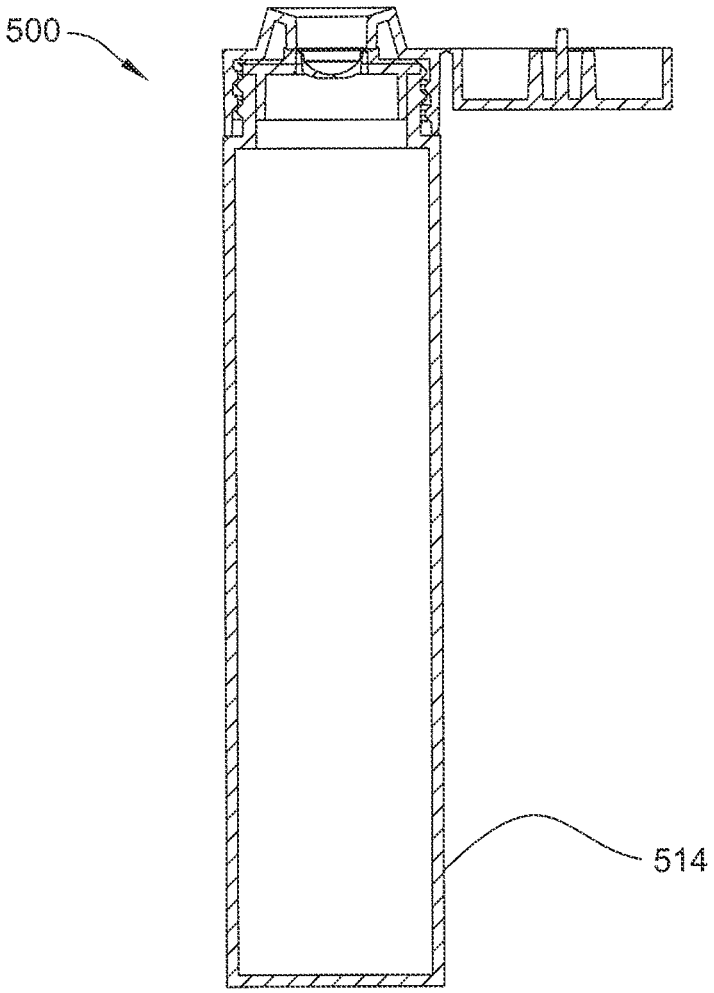
FIG. 25 is a cross-sectional view of another embodiment of a container.

Referring to FIG. 25, another embodiment of a container is shown. The container 500 is the same as container 400 except that the container 500 is a bottle with a closed lower end portion 514.

Figure 26:
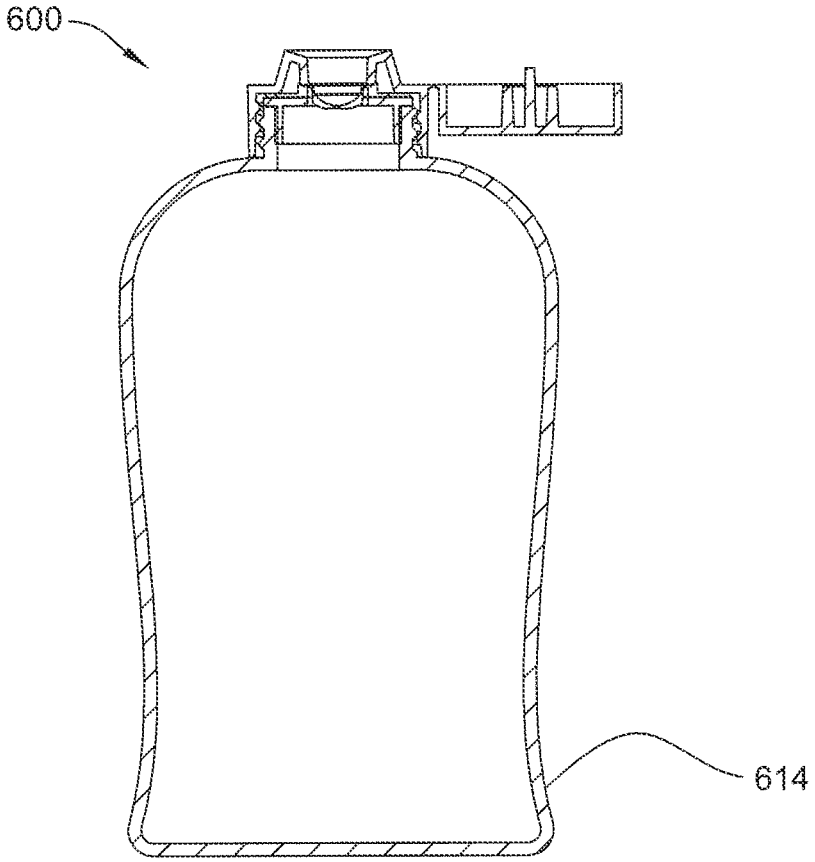
FIG. 26 is a cross-sectional view of another embodiment of a container.

Referring to FIG. 26, another embodiment of a container is shown. The container 600 is the same as container 500 except that the container 600 has a body portion with a different shape. The container 600 may be a bottle with a closed lower end portion 614 or the container 600 may be a tube with a closed lower end portion 614.

Figure 27:
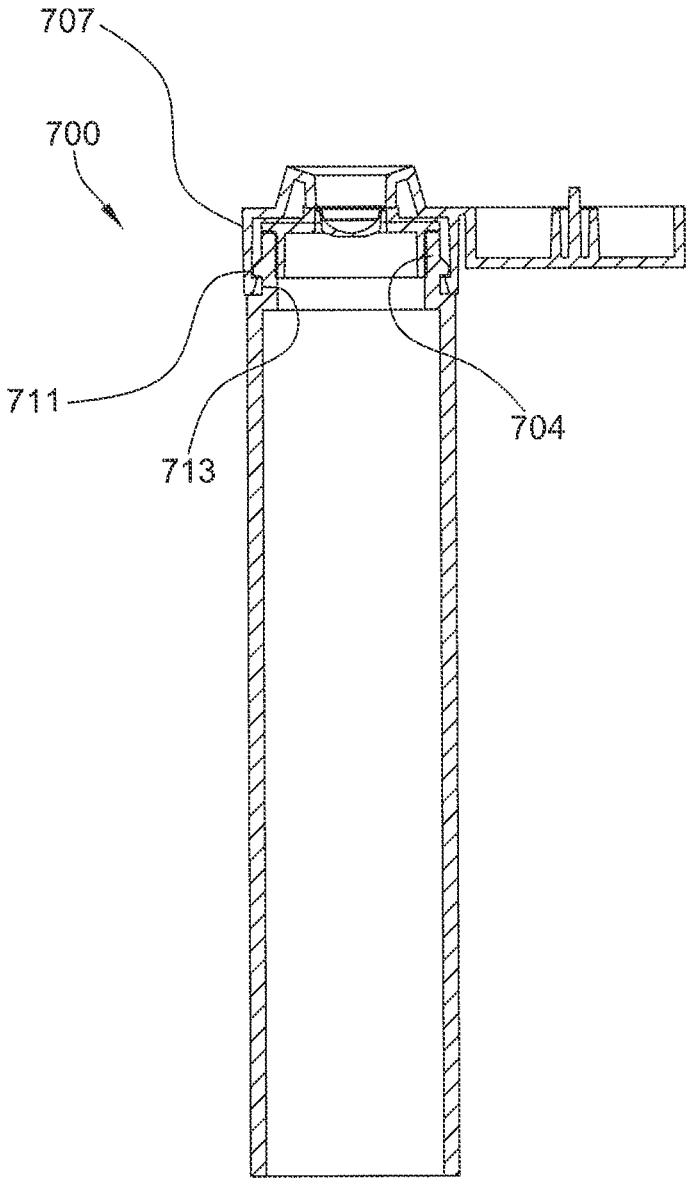
FIG. 27 is a cross-sectional view of another embodiment of a container.

Referring to FIG. 27, another embodiment of a container is shown. The container 700 is the same as container 400 except that the container 700 has a snap attachment to connect the base portion 707 to the end portion 704. The end portion 704 includes one or more protrusions 711 which engage one or more protrusions 713 on the base portion 707.

Figure 28:
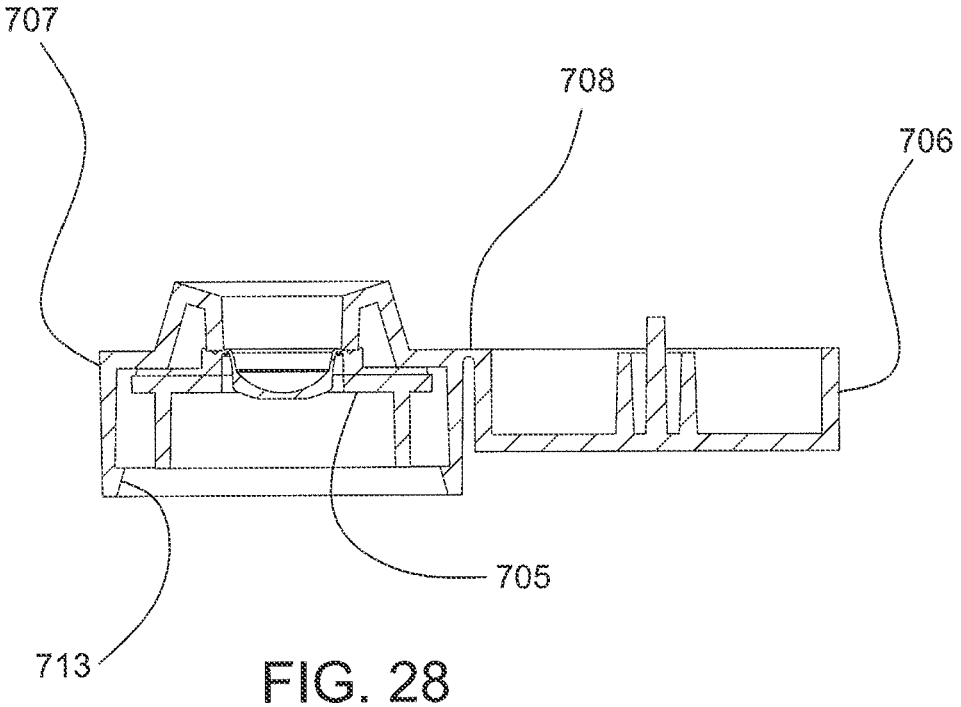
FIG. 28 is a cross-sectional view of a base portion and a cap portion from FIG. 27.

Referring to FIG. 28, the cap portion 706, a base portion 707, and a hinge portion 708 are shown. The base portion 707 includes the one or more protrusions 713. The plug seal 705 is also shown inserted into the base portion 707.

Figure 29:
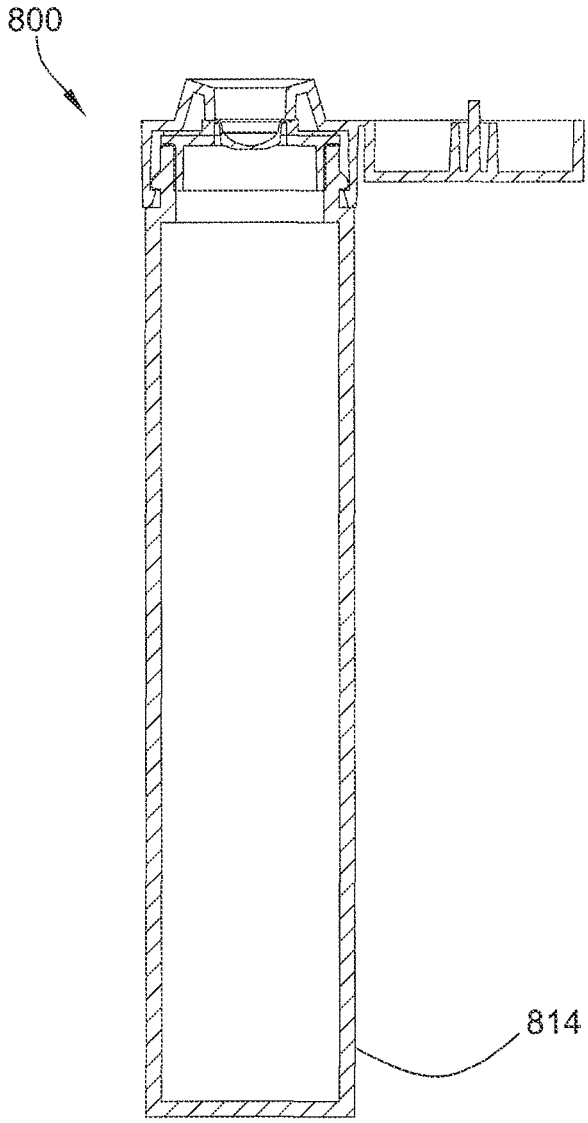
FIG. 29 is a cross-sectional view of another embodiment of a container.

Referring to FIG. 29, another embodiment of a container is shown. The container 800 is the same as container 700 except that the container 800 is a bottle with a closed lower end portion 814.

Figure 30:
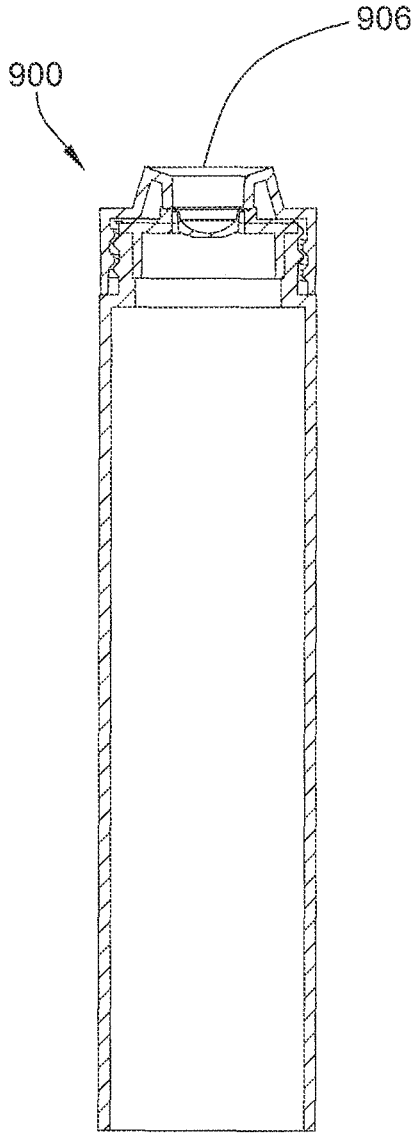
FIG. 30 is a cross-sectional view of another embodiment of a container.

Referring to FIG. 30, another embodiment of a container is shown. The container 900 is the same as container 400 except that the container 900 has a seal 906. The seal may be a plastic seal, a foil seal, a plastic seal with a paper backing, a foil seal with a paper backing, or other type of seal.

Figure 31:
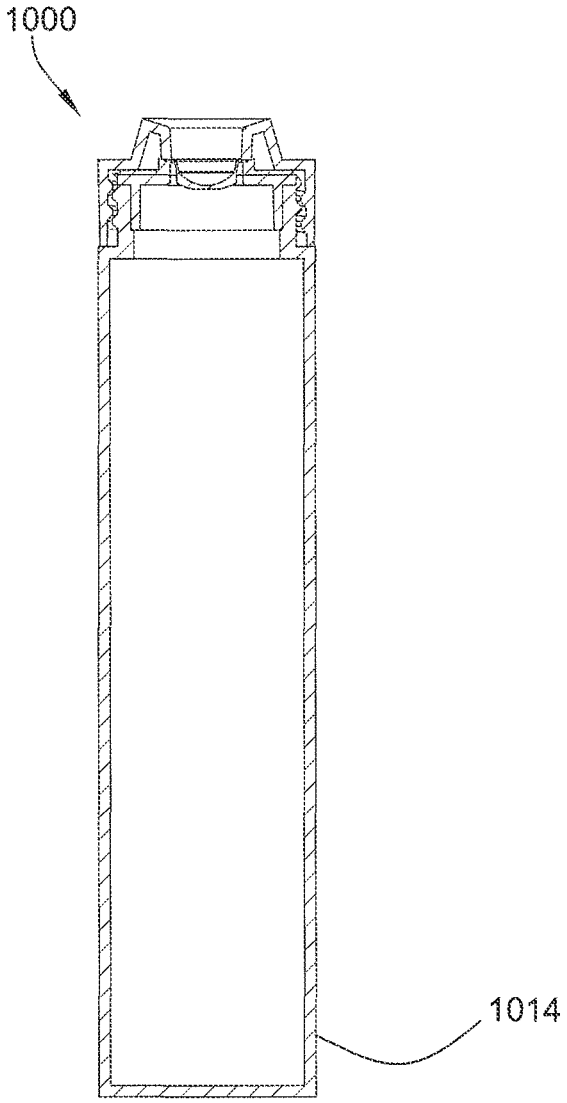
FIG. 31 is a cross-sectional view of another embodiment of a container.

Referring to FIG. 31, another embodiment of a container is shown. The container 1000 is the same as container 900 except that the container 1000 is a bottle with a closed lower end portion 1014.

This application incorporates by reference in its entirety U.S. Design Pat. Application No. 29/450,116, filed on Mar. 15, 2013 with Leydig Reference Number 712288.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A container for dispensing a product comprising:

an upper end portion, the upper end portion includes an opening, the upper end portion includes a first attachment portion, a lower end portion, a body portion, the body portion extends away from the upper end portion, the body portion includes a side wall, a base portion, the base portion includes a second attachment portion, the second attachment portion of the base portion is attached to the first attachment portion of the upper end portion, a plug seal, the plug seal connected to the upper end portion, the plug seal covers the opening of the upper end portion, the plug seal includes a valve, the plug seal includes a retaining ring, the retaining ring creates a liquid seal with the upper end portion, the valve is attached to the retaining ring, the valve includes a valve opening, the valve opening opens when a product is being dispensed from the container, the valve opening closes when a product is not being dispensed from the container.

2. The container as in claim 1 wherein a cap portion is connected to the base portion with a hinge portion.

3. The container as in claim 1 wherein the retaining ring includes a wall, the wall creates the liquid seal with the upper end portion.

4. The container as in claim 1 wherein the base portion is attached to the upper end portion with threads.

5. The container as in claim 1 wherein the side wall has a first thickness near the upper end portion, the side wall has a second thickness near the lower end portion, the first thickness is greater than the second thickness.

6. The container as in claim 1 wherein the side wall has a thickness, the thickness of the side wall tapers near the upper end portion toward the lower end portion.

7. The container as in claim 1 wherein the valve is molded onto the retaining ring.

8. The container as in claim 1 wherein the valve is molded separately from the retaining ring.

9. The container as in claim 1 wherein the base portion is attached to the upper end portion with a snap attachment.

10. The container as in claim 9 wherein the snap attachment is a protrusion.

11. The container as in claim 1 wherein the container includes a seal.

12. The container as in claim 11 wherein the seal is attached to the base portion.

13. The container as in claim 1 wherein the lower end portion is closed.

14. The container as in claim 13 wherein the lower end portion is closed by a heat seal.

15. A method of making a container for dispensing a product comprising:

providing a container including an upper end portion, the upper end portion includes an opening, the upper end portion includes a first attachment portion, a lower end portion, a body portion, the body portion extends away from the upper end portion, the body portion includes a side wall, a base portion, the base portion includes a second attachment portion, the second attachment portion of the base portion is attached to the first attachment portion of the upper end portion, a plug seal;

inserting the plug seal into the upper end portion, the plug seal covers the opening of the upper end portion, the plug seal includes a valve, the plug seal includes a retaining ring, the retaining ring creates a liquid seal with the upper end portion, the valve is attached to the retaining ring, the valve includes a valve opening, the valve opening opens when a product is being dispensed from the container, the valve opening closes when a product is not being dispensed from the container;

filling the container with the product; and closing the lower end portion.

16. The method of claim 15 wherein the closing the lower end portion is performed by heat sealing.

17. The method of claim 15 wherein the valve is molded onto the retaining ring.

18. The method of claim 15 wherein the valve is molded separately from the retaining ring.

19. The method of claim 15 wherein the retaining ring includes a wall, the wall creates the liquid seal with the upper end portion.

20. The method of claim 15 wherein the container includes a seal.

* * * * *